US005412828A

United States Patent [19]

Kuhlmey et al.

[11] Patent Number: 5,412,828

[45] Date of Patent: May 9, 1995

[54] FREE FORUM HAIR CARE BRUSH

[76] Inventors: Albert J. Kuhlmey, 6119 N. Artesian, Chicago, Ill. 60659; George Spector, 233 Broadway Rm 702, New York, N.Y. 10279

[21] Appl. No.: 109,244

[22] Filed: Aug. 20, 1993

[51] Int. Cl.[6] ..... A46B 7/10

[52] U.S. Cl. ..... 15/27; 15/159.1; 15/179

[58] Field of Search ..... 15/27, 104.002, 230.11; 492/13, 16–19

[56] References Cited

U.S. PATENT DOCUMENTS

| | | | |
|---|---|---|---|
| 4,197,608 | 4/1980 | Holley | 15/27 |
| 4,496,825 | 1/1985 | Andis | 15/27 |
| 4,656,684 | 4/1987 | Jewett | 15/27 |
| 4,685,165 | 8/1987 | Fronius | 15/27 |

FOREIGN PATENT DOCUMENTS

| | | | |
|---|---|---|---|
| 401906 | 5/1966 | Switzerland | 15/27 |
| 602041 | 7/1978 | Switzerland | 15/27 |

*Primary Examiner*—Timothy F. Simone
*Assistant Examiner*—Terrence R. Till

[57] ABSTRACT

A free form hair care brush is provided, which consists of a handle with a collar formed on one side of the handle and a shaft extending from the collar. A bristle attachment is rotatively positioned onto the shaft. A retainer cap is mounted onto a distal end of the shaft opposite from the collar, to keep the bristle attachment on the shaft. A rotating action of the bristle attachment will glide through hair rather than pull the hair, thereby making hair styling easier and reduce hair damage.

1 Claim, 1 Drawing Sheet

FREE FORUM HAIR CARE BRUSH

BACKGROUND OF THE INVENTION

The instant invention relates generally to hair grooming implements and more specifically it relates to a free form hair care brush, which provides a rotating action bristle attachment to reduce hair damage.

There are available various conventional hair grooming implements which do not provide the novel improvements of the invention herein disclosed.

SUMMARY OF THE INVENTION

A primary object of the present invention is to provide a free form hair care brush that will overcome the shortcomings of the prior art devices.

Another object is to provide a free form hair care brush with a rotating action bristle attachment that will allow the brush to glide through hair, rather than pull it to make hair styling easier and reduce hair damage.

An additional object is to provide a free form hair care brush in which the rotating action of the bristle attachment can be adjustably changed to give the brush a multi-purpose function.

A further object is to provide a free form hair care brush that is simple and easy to use.

A still further object is to provide a free form hair care brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
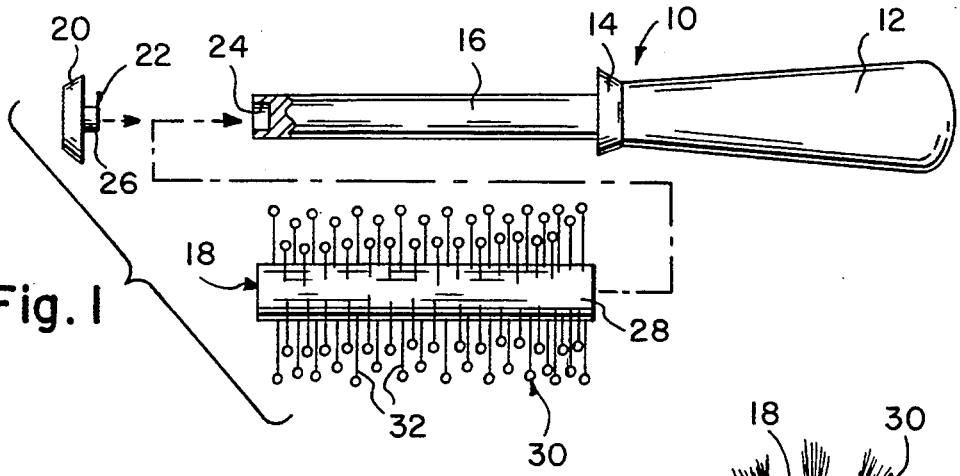
FIG. 1 is an exploded side view of the instant invention with parts broken away and in section.

Turning now descriptively to the drawings, in which similar reference characters denote similar elements throughout the several views, FIG. 1 illustrates a free form hair care brush 10, which consists of a handle 12, a collar 14 formed on one side of the handle and a shaft 16 extending from the collar 14. A bristle attachment 18 is rotatively positioned onto the shaft 16. A retainer cap 20 is provided. A structure 22 is for mounting the retainer cap 20 onto a distal end of the shaft 16 opposite from the collar 14, to keep the bristle attachment 18 on the shaft 16. A rotating action of the bristle attachment 18 will glide through hair rather than pull the hair, thereby making hair styling easier and reduce hair damage.

The mounting structure 22 includes the shaft 16 having a socket 24 formed in its distal end. A shank 26 extends from an inner side of the retainer cap 20, which fits snugly into the socket 24 in the shaft 16.

Figure 2:
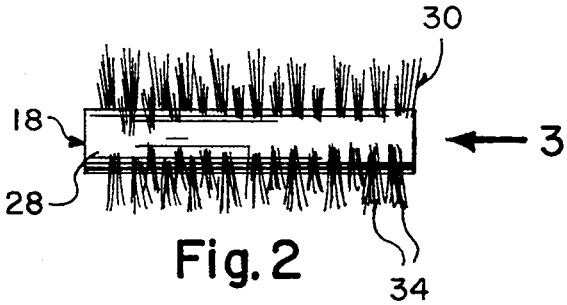
FIG. 2 is a side view of a natural bristle attachment.
Figure 3:
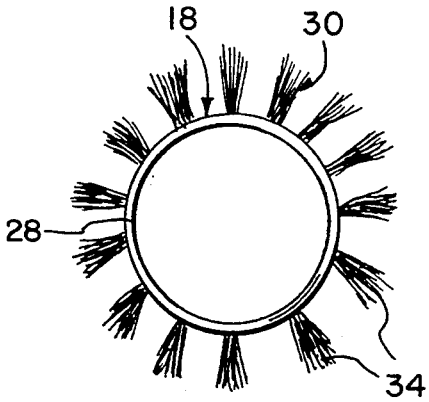
FIG. 3 is an enlarged and view taken in the direction of arrow 3 in FIG. 2.

The bristle attachment 18 contains a sleeve 28, sized to rotatively fit onto the shaft 16. A plurality of bristles 30 extend radially from the sleeve 28 to engage with the hair. The bristles 30 in FIG. 1, are plastic bristle fingers. The bristles 30 in FIG. 2 and 3, are groups of natural bristles 34.

Figure 4:
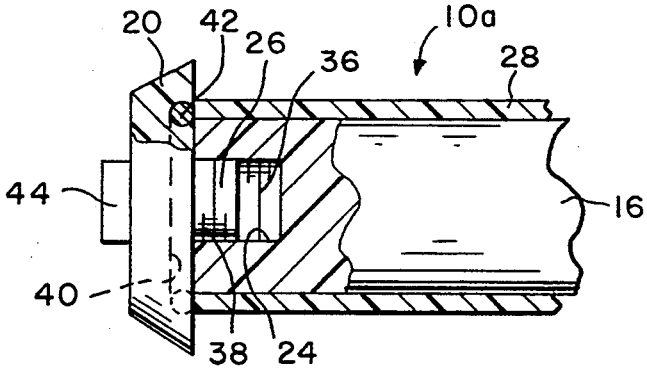
FIG. 4 is an enlarged Side view with parts broken away and in section of a modification, in which the retainer cap is adjustable to change the rotation of the bristle attachment.

FIG. 4 shows a modified free form hair care brush **10*a* further including the socket 24 in the shaft 16, having internal threads 36. The shank 26 on the retainer cap 20 has external threads 38, so that the shank 26 can be screwed into the socket 24. The retainer cap 20 has an annular groove 40 in its inner side and is of a size as the diameter of the sleeve 16. A ball bearing race 42 fits into the annular groove 40 adjacent an end of the sleeve 28. A finger grip 44 is formed on an outer side of the retainer cap 20. The retainer cap 20 can be tightened and loosened to change the rotation action of the bristle attachment 18, when the ball bearing race 42 moves towards and away from the end of the sleeve 28**.

OPERATION OF THE INVENTION

To use the free form hair care brush 10, a person simply grips the handle 12, slips the sleeve 28 of the bristle attachment 18 over the shaft 16 and inserts the shank 26 on the retainer cap 20 into the Socket 24 on the shaft 16. The bristle attachment 18 will rotate about the shaft 16 when used on the hair. In a modified brush **10*a*, a person can turn the finger grip 44 on the retainer cap 20, to change the rotating action of the bristle attachment 18, to give the brush 10*a*** a multi-purpose function.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A free form hair care brush which comprises:

a) a handle;

b) a collar formed on one side of said handle;

c) a shaft extending from said collar;

d) a bristle attachment rotatively positioned onto said shaft;

e) a retainer cap;

f) means for mounting said retainer cap onto a distal end of said shaft opposite from said collar, to keep said bristle attachment on said shaft, so that a rotating action of said bristle attachment will glide through hair rather than pull the hair, thereby making hair styling easier and reduce hair damage; wherein said mounting means includes:

g) said shaft having a socket formed in its distal end;

h) a shank extending from an inner side of said retainer cap, which fits snugly onto said socket in said shaft, wherein said bristle attachment includes:

i) a sleeve sized to rotatively fit onto said shaft;

j) a plurality of bristles extending radially from said sleeve to engage with the hair; wherein k) said socket in said shaft having internal threads;

l) said shank on said retainer cap having external threads so that said shank can be screwed into said socket;

m) said retainer cap having an annular groove in its inner side and being of a size as the diameter of said sleeve;

n) a ball bearing race to fit into said annular groove adjacent an end of said sleeve; and o) a finger grip formed on an outer side of said retainer cap, so that said retainer is tightened and loosened to change the rotation action of said bristle attachment, when said ball bearing race moves towards and away from the end of said sleeve.

* * * * *